United States Patent [19]

Buck et al.

[11] Patent Number: 4,673,382

[45] Date of Patent: Jun. 16, 1987

[54] APPARATUS FOR FORMING FOLDED STACKS FROM A WEB

[75] Inventors: Hermann Buck, Dettingen/Erms; Werner Sommer, Beuren, both of Fed. Rep. of Germany

[73] Assignee: Bielomatik Leuze GmbH & Co., Fed. Rep. of Germany

[21] Appl. No.: 821,390

[22] Filed: Jan. 22, 1986

[30] Foreign Application Priority Data

Jan. 23, 1985 [DE] Fed. Rep. of Germany ..... 3502176

[51] Int. Cl.[4] ..... B65H 45/20

[52] U.S. Cl. ..... 493/359; 493/412; 83/92; 270/39

[58] Field of Search ..... 493/356, 357, 359, 360, 493/412, 430, 433; 83/92; 270/39

[56] References Cited

U.S. PATENT DOCUMENTS

| | | | |
|---|---|---|---|
| 2,675,747 | 4/1954 | Greiner et al. | 493/360 |
| 2,761,677 | 9/1956 | Rutkus et al. | 270/39 |
| 3,301,111 | 1/1967 | Nystrand | 83/92 |
| 3,892,168 | 7/1975 | Grobman | 414/36 |
| 4,205,836 | 6/1980 | Nystrand | 493/357 |
| 4,405,186 | 9/1983 | Sandberg et al. | 414/21 |
| 4,406,650 | 9/1983 | Felix | 493/410 |
| 4,508,527 | 4/1985 | Uno et al. | 493/357 |
| 4,522,094 | 6/1985 | Messe et al. | 83/92 |

FOREIGN PATENT DOCUMENTS

| | | |
|---|---|---|
| 1215175 | 11/1966 | Fed. Rep. of Germany . |
| 2447983 | 4/1978 | Fed. Rep. of Germany . |
| 3013865 | 12/1981 | Fed. Rep. of Germany . |

*Primary Examiner*—Frederick R. Schmidt
*Assistant Examiner*—William E. Terrell
*Attorney, Agent, or Firm*—Steele, Gould & Fried

[57] ABSTRACT

Zig-zag folded layers of paper webs are stacked downstream of a folder on a lifting table. A belt is raised to hold a nearly completed stack from below and a separating rake with leading spear shaped heads is moved into the stack at a division between sheets, and severs the stack along a fold. The lifting table and separating rake are shifted together as the separating rake advances, during which the stack to be removed is supported on the raised belt. A new partial stack accumulates on the separating rake while the old stack is removed, the belt is lowered and the table is raised. The table and rake are then returned to their original position to resume stacking on the table. Shifting of the table and separating means, and movement of the raised belt, are driven from a common drive by means of a controllable freewheel clutch engaging over a part of the cycle.

21 Claims, 8 Drawing Figures

APPARATUS FOR FORMING FOLDED STACKS FROM A WEB

BACKGROUND OF THE INVENTION

The invention relates to an apparatus for folding material webs, particularly paper webs and for accumulating folded lengths in a stack of folded layers. The invention includes a folder and a stacker, and the stack is accumulated with the web moving one stacking direction.

U.S. Pat. No. 3,301,111 discloses an apparatus in which horizontal dividing or separating elements are inserted at the start of the stack just after the folder and which are constructed for carrying a partial stack and for severing the folded paper web at a fold. The apparatus operates by means of a cutting edge on a separating and carrying means inserted horizontally in the stack. The removal means for the separated stack has a conveyer belt on which are placed the separated stacks by plates working as a stacking table. Such an apparatus is also described by U.S. Pat. No. 2,761,677.

German Pat. No. 3013865 (equivalent to U.S. Pat. No. 4,406,650) describes an apparatus solving the stack separation and removal problems in the same way. However, additionally therein, the partial stacks are held above and below the separating means throughout the separating process at their first and last sheets by separate holding means, so as to avoid any displacement of the stack during separation. However, this requires the use of complicated machine parts, such as suction means and the like.

SUMMARY OF THE INVENTION

The problem of the present invention is to so improve the apparatus of U.S. Pat. No. 3,301,111 that it permits an accurate formation of individual stacks and the removal thereof at high running speeds without any need for holding means for the stack parts above and below the separating means.

According to the invention this problem is solved in that the stacking table is provided with a displacement means and the table can be inserted by the displacement means in an upper position substantially horizontally into the stacking zone synchronously and in the same direction as the separating means, being linked with the separating means and following it substantially without any spacing during introduction.

The invention requires no holding means. On retracting the separating means, the stacking table follows it and takes over support of the partial stack, without there being any need to fear a tilting or displacement of the stack. It is also possible to provide two separating means which, apart from their transverse movement, would also be lowerable and which in endless chain-like manner alternately assume responsibility for the separation and carrying of successive stacks.

According to a preferred embodiment a gap is formed on the front stack edge by a dividing member pivotable from its upper edge into the stack, so that the separating element can be moved without difficulty into the stack. It only opens the front stack edge and does not carry the stack over its remaining surface. However, it is also possible to move the separating means from above into the stack. The separating means, which advantageously comprises a rake-like element with separating edges cooperating with a correspondingly recessed guide member, particularly as the separating means are constructed in lowereable and raisable manner. Thus, the separating means does not have to be introduced precisely perpendicularly to the stack direction or in the direction of the plane of the layers into said stack, particularly not during the entire operation thereof.

Particular preference is given to a construction of the separating means in which the latter comprises parallel bars in the introduction direction having separating heads, which are constructed as block-like tips and ensure that the perforation on the fold is broken open and not cut open, which prevents any risk of stack displacement and cutting into the web.

Features of preferred further developments of the invention can be gathered from the claims the description and drawings, whereby the individual features can be realized in an embodiment of the invention, either alone or in various subcombinations. An embodiment of the invention is shown in the drawings and is described in further detail hereinafter.

DETAILED DESCRIPTION OF THE INVENTION

Figure 1:
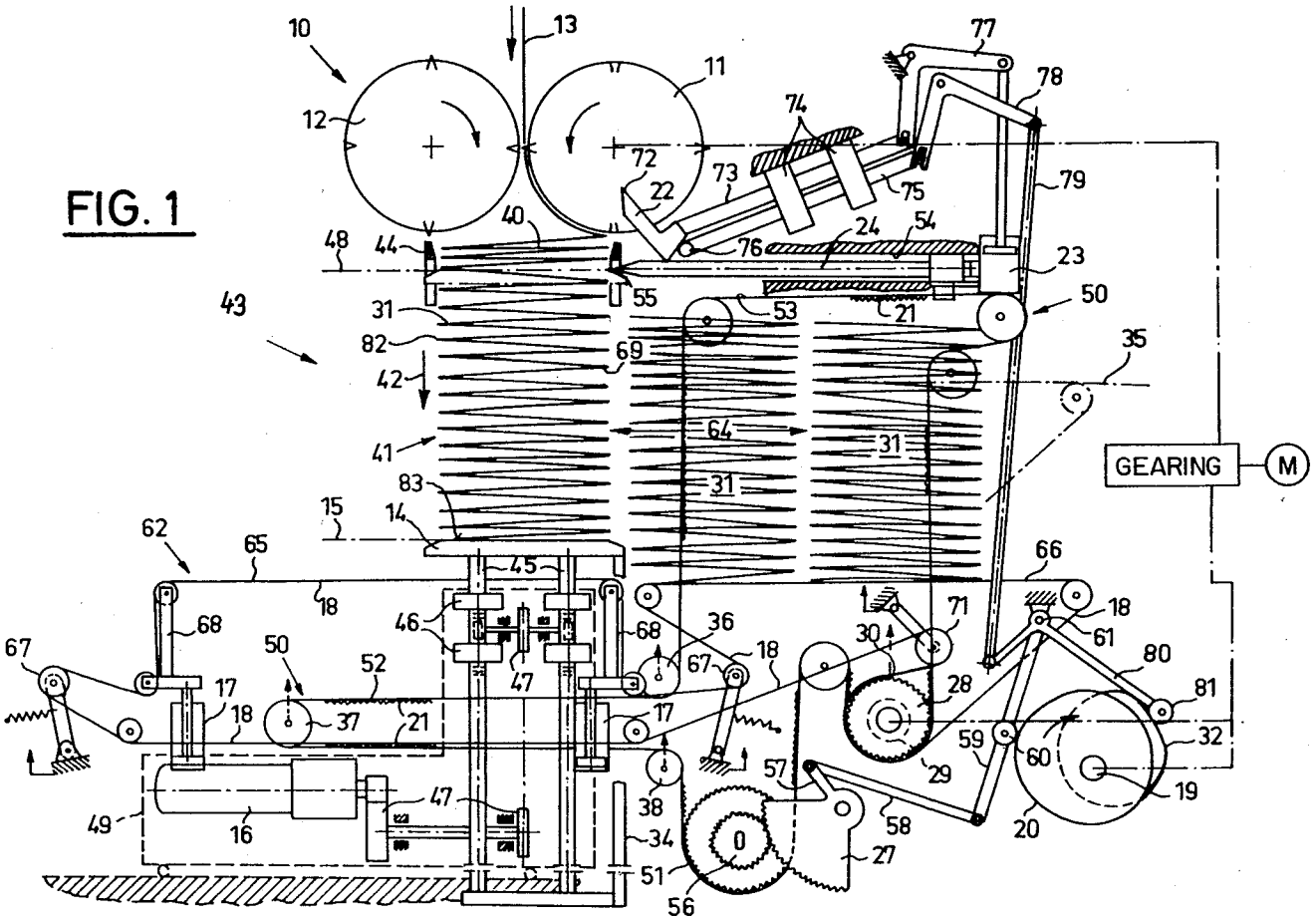
FIGS. 1 to 5 show diagrammatic views of the apparatus in five different working positions, and some of the drawings, for clarity reasons only show those elements of the whole which are necessary for illustrating the particular working step.

The apparatus shown in FIGS. 1 to 5 is normally the end section of an apparatus for producing folded layers from a material web 13, particularly a paper web. Upstream of a folder 10, the normally single, but multiply used material webs 13, i.e. juxtaposed in several format widths are printed, provided with perforations, holes and the like.

The material web which in the present, represented example passes vertically from above into folder 10 is nipped between two folding rollers 11, 12 and provided with alternate folds at a predetermined spacing and then placed in a stack 31 in the form of zig-zag layers 40. The stack is formed in a stacking zone or shaft 41 and its front advances in the stacking direction 42, which is in this case vertically downwards.

The specific folder used with the invention can be a per se known flap folder, as is e.g. known from German specification No. 78 663, to which reference is made. By means of change or variable speed gearing, folder 10 driven synchronously with a shaft 19, which controls a large part of the functions of the complete stacking means 43.

Guide members 44 are arranged on the leading and trailing edge on the upper part of the stacking zone 41 adjacent to folder 10. The guide members guide the stack 31 between them in said upper zone and are constructed in the manner of shaped like rakes or combs. In the working position according to FIG. 1, stack 31 rests on a lowerable stacking table 14 carried by columns 45, which are vertically displaceably guided in guides 46 and, e.g. by means of racks on the columns, are raisable and lowerable by a motor 16 via a sprocket and chain drive 47, namely from the lower position 15 to the upper position 48 shown in dot-dash line form.

Motor 16, drive 47 and guides 46 and consequently the complete stacking table 14 are fitted to a horizontally displaceable slide 49 shown in broken line form. It is horizontally displaceable between the right-hand position of FIGS. 1, 2 and 5 and the left-hand position of FIGS. 3 and 4. Slide 49 is displaceable in that it is coupled to a toothed belt 21, which is part of displacement means 50. Toothed belt 21 is endlessly guided around numerous deflector rolls, e.g. 36, 37, 38, a driving gear 51 and an entrainer gear 28. Apart from the horizontal length 52 of belt 21 driving slide 49, there is a horizontal length 53, which can move a separating means 24 horizontally backwards and forwards, the separating means 24 running in a horizontal guide 54.

The separating means 24 comprises several rake-like or comb-like, horizontally juxtaposed bars, e.g. round bars, which are provided at the front side with a tip or cutting edge 55 and can pass through the matched comb-like guide members 44. Separating means 24 can be moved backwards and forwards between the position shown in FIG. 1 in which it is located outside the stacking zone 41 and the position according to FIG. 3 in which the tips 55 pass through the left-hand guide member 44.

The displacement means 50 is driven by means of a gear 56 rotationally fixed manner to the driving gear 51, a toothed segment 27 in engagement therewith, a crank 57 connected thereto, a connecting rod 58 and a one-arm lever 59, which is fitted in an articulated manner to a swivel bearing 61 and carries a drive roll 60, which follows a cam 20 on shaft 19. Segment 27 is moved backwards and forwards by cam 20 via linkage 57 to 61 and thereby periodically reciprocates the driving gear 51, so that the separating means 24 and slide 49 coupled thereto are moved backwards and forwards in the same direction horizontally and by the same amount. The toothed belt drive could be replaced by some other displacement means, e.g. using levers driven from a cam or a pneumatic drive. However, a relatively adaptable displacement means is provided by the two toothed belts running upstream and downstream of the stacking zone in the drawing, whereby there is a simultaneous driving of a belt conveyer 18 forming a removal means 62 for stacks 31.

For this purpose the toothed belt runs around the entrainer gear 28 and is periodically reciprocated by gear 28. The entrainer gear 28 is connected via a freewheel means 29 to the driving gear 30 for belt conveyor 18, the driving gear only being entrained in the clockwise direction and consequently the belt 18 is only intermittently conveyed in one direction, namely by amount 64, i.e. the spacing between two stacks on the removal section.

Belt conveyor 18 is guided round several deflector rolls in such a way that it forms two horizontal belt sections 65,66, whereof one of them 65, running in the vicinity of the stacking table, is independently raisable from belt section 66. At the beginning and end of belt section 65, the belt is guided in Z-shaped manner by means of in each case one deflector roll pair fitted to a lifting element 68 and following onto this is provided with compensating sections, which are held under tension by spring-loaded deflector rolls 67. The lifting elements 68 can be simultaneously raised by pneumatic cylinders 17 and consequently raise belt section 65 over the plane of the lower position 15 of stacking table 14 (cf. FIGS. 2 and 3). In the lowered position shown in FIG. 1, belt sections 65, 66 are at the same level. The belt conveyor 18 comprises spaced belts, through whose plane can consequently pass the stacking table comprising individual, spaced strips. To the bottom of stacking table 14 is connected at least one strip-like support 34. The left-hand stacking edge of a stack to be removed can be supported on support 34 during the removal of the stack from the stacking zone and during the transfer between the belt sections 65, 66 together with means 65. The support is connected via a yoke at the lower end.

A dot-dash line in FIG. 1 shows that for manual setting purposes the complete belt section 18 with its deflector rolls, the lifting mechanism 17, 68 and the driving gear 30, together with the stacking table and slide 49 can be raised into an upper position 35, if higher stacks are to be produced. This is accompanied by the raising of displacement means 50 with its deflector rolls 36, 37, 38, toothed belt 21 and entrainer gear 28, whereas driving gear 51 remains fixed. The drive of displacement means 50 and the removal means 62 indirectly driven by the latter is consequently not impaired by the height setting.

A dividing member 22 comprising a ratchet-like lever with a tip or cutting edge 72 is positioned on the upper edge of stack 31 and over the separating means 24. It is fitted in articulated manner to one end of a rod 73 guided in sliding guides 74 over separating means 24 under an angle between approximately 10° and 30° relative to the horizontal.

Parallel and below rod 73 is guided a further rod 75, which acts on the dividing member 22 by a roll 76 at its end and can consequently pivot said member between an upwardly sloping position (FIG. 1) and a downwardly sloping position towards the stack (approximately in the extension of rods 73, 75, as in FIGS. 2 and 3). Rod 73 is connected by means of a bent lever 77 to the piston of a pneumatic cylinder 23, whilst rod 75 is connected via a double lever 78 and a connecting rod 79 to a double lever 80 pivotable about the swivel bearing 61, said double lever being pivotable by means of a driving roller 81 by a cam 32 fitted to shaft 19.

Dividing member 22 is arranged in such a way that it is normally in the vicinity of the right-hand stacking edge 69 above the stack, i.e. in the vicinity of folding roller 11, so that it can engage from above in the stack before the next fold falls. In its downwardly pivoted position, the dividing member 22 is located in a gap of the separating means, but its tip is precisely in front of the retracted tip of separating means 24, so that it makes a gap for the separating means in the stack, which can be penetrated by said means without any risk of damaging the stack.

The present apparatus operates in the following way. FIG. 1 shows a working stage in which the formation of a high stack 31 on stacking table 14 has been virtually completed. Stacking table 14 has reached its lower position 15, but the separating means 24 and dividing member 22 are still outside the stacking zone 41.

Figure 2:
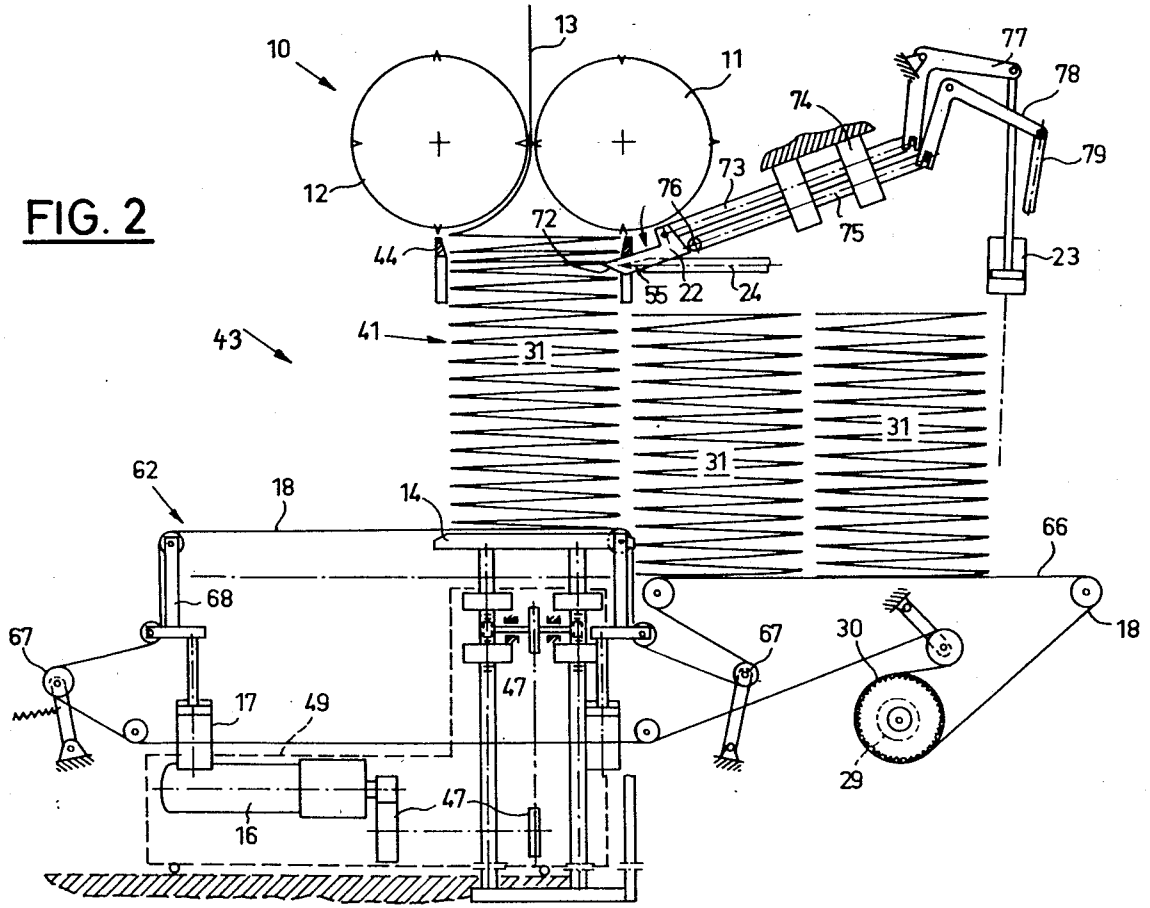

As shown in FIG. 2 by operating the pneumatic cylinder 23 rod 73 is advanced toward the stack by means of a lever 77, so that the dividing member is swung into the stacking zone 41, dividing successive layers from the top layer just formed on the folder. Dividing member 22 pivots into the described position in which its tip 72 is in front of the separating means tip 55. Simultaneously the belt section 65 of belt conveyor 18 of removal means 62 is raised above the same through the plane of stacking table 14, so that it takes over stack 31.

This takes place by operating pneumatic cylinder 17 using the compensating section formed by the cushioned deflector rolls 67.

Immediately thereafter, via linkage 57 to 61, cam 20 actuates toothed segment 57 and consequently driving gear 51 of toothed belt 21 in such a way that the resultingly formed displacement means 50 simultaneously draws horizontally to the left side 49, consequently displacing to the left stacking table 14 with its lifting mechanism the separating means 24 in guide 54 is also shifted to the left by belt 21, so that the stacking table now is to the left alongside stacking zone 41 and the separating means 24 moves into the gap formed by dividing member 22 in the vicinity of stacking edge 69. The separating means 24 passes between two layers 40 and severs these two layers in the vicinity of a rear fold 82, where the layers are generally only connected by a perforated line (FIG. 3). The tips or cutting edges 55 of the bars forming the separating means cooperate with the guide member forming a type of abutment or counter-cutting edge. Independently of the nature of the guide members or separating means, it is possible to use different separation modes and these are largely dependent on the desired separating quality and the nature of the fold e.g., the (degree of perforation). However, it has been found that the separation by means of the individual tips or cutting edges leads to an adequately reliable and clean separation for most practical applications.

Figure 3:
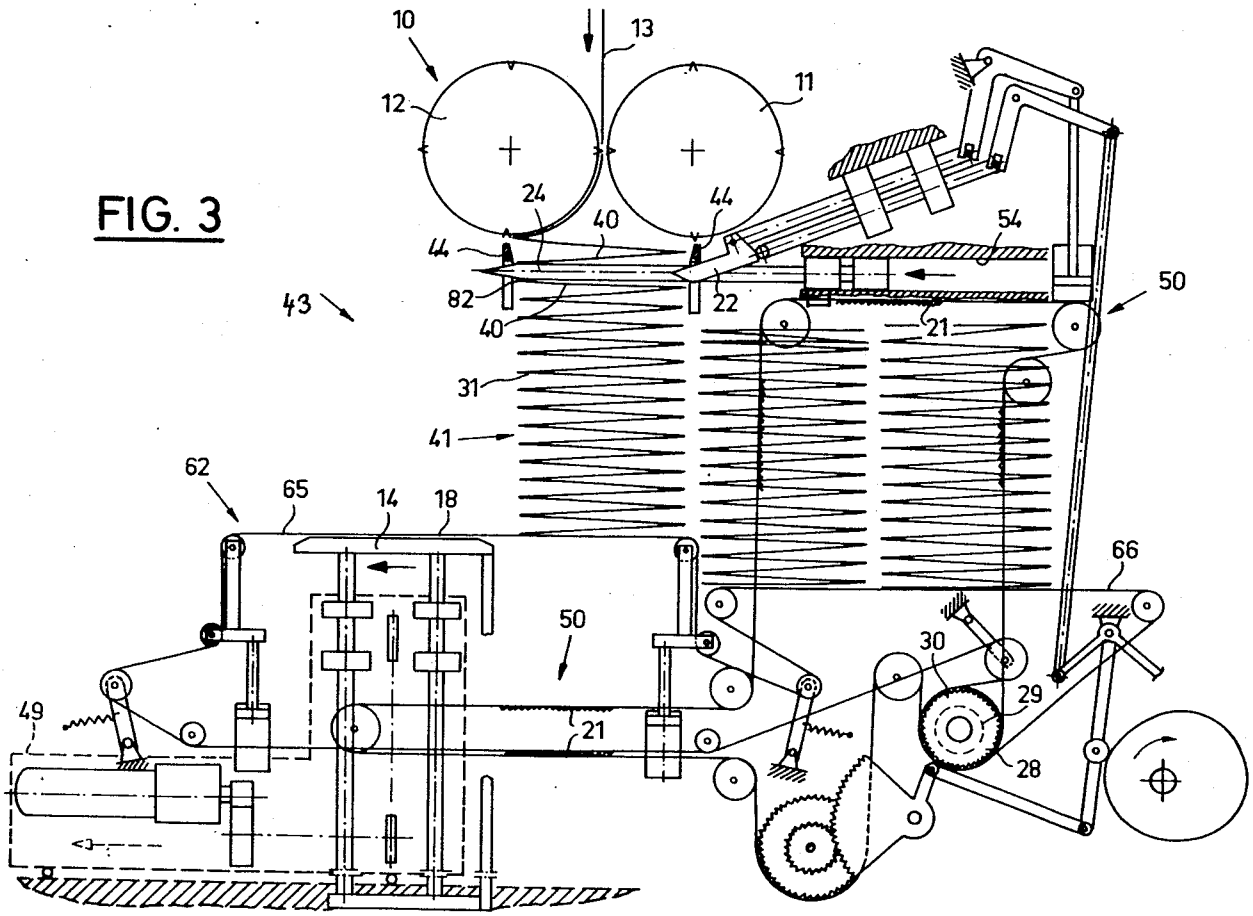

During the movement of the toothed belt 21 between the position of FIGS. 2 and 3, the freewheel means 29 was used so that the belt conveyor 18 was not moved together with toothed belt 21.

Figure 4:
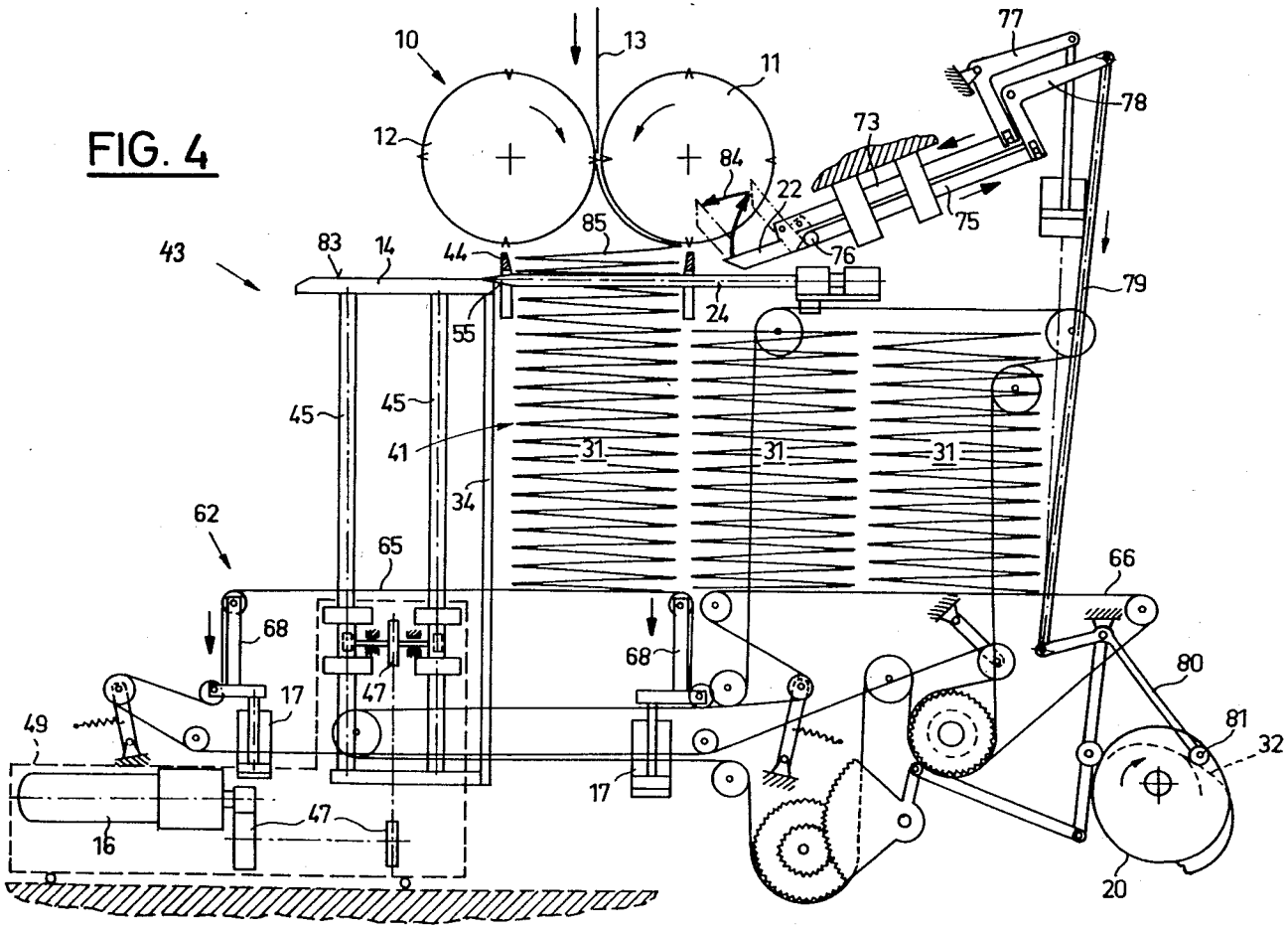

FIG. 4 shows that by retracting the piston into pneumatic cylinder 17, the lifting elements 78 are lowered again, so that belt section 65 once again is at the level of belt section 76 and stack 31 is correspondingly lowered. Simultaneously through the operation of motor 16 via drive 47, stacking table 14 is raised through the belt plane into position 48 in which its stacking surface 83 is approximately aligned with the upper edge of the separating means 24. Stacking table 14 moves upwards alongside stacking zone 41.

In FIG. 4, through the simultaneous retraction of the two rods 73, 74, the driving member 22 is retracted from the stacking zone. This takes place by means of the two angle levers 77, 78 and the operation of pneumatic cylinder 23 and by cam 32. Under the action of pneumatic cylinder 23 and cam 32, the pivoting and advance movement indicated by the curving arrow 84 in FIG. 4 is performed, in which initially the dividing member 22 is swung upwards by the advance of rod 75 with rod 73 in the retracted position then through the simultaneous movement of rods 73, 75 towards the stack, dividing member 22 in its upwardly directed position is moved into the waiting position according to FIGS. 1 and 5, so that it is again ready for use. Since the introduction of separating means 24 (FIGS. 3 and 4), a new partial stack 85 has been forming on said separating means, which consequently carries partial stack 85 during this time. Thus, although the separating means is relatively close to the folder, it has a sufficient spacing for a partial stack formed up to the end of the stack change process to be housed between the separating means 24 and folder 10.

Figure 5:
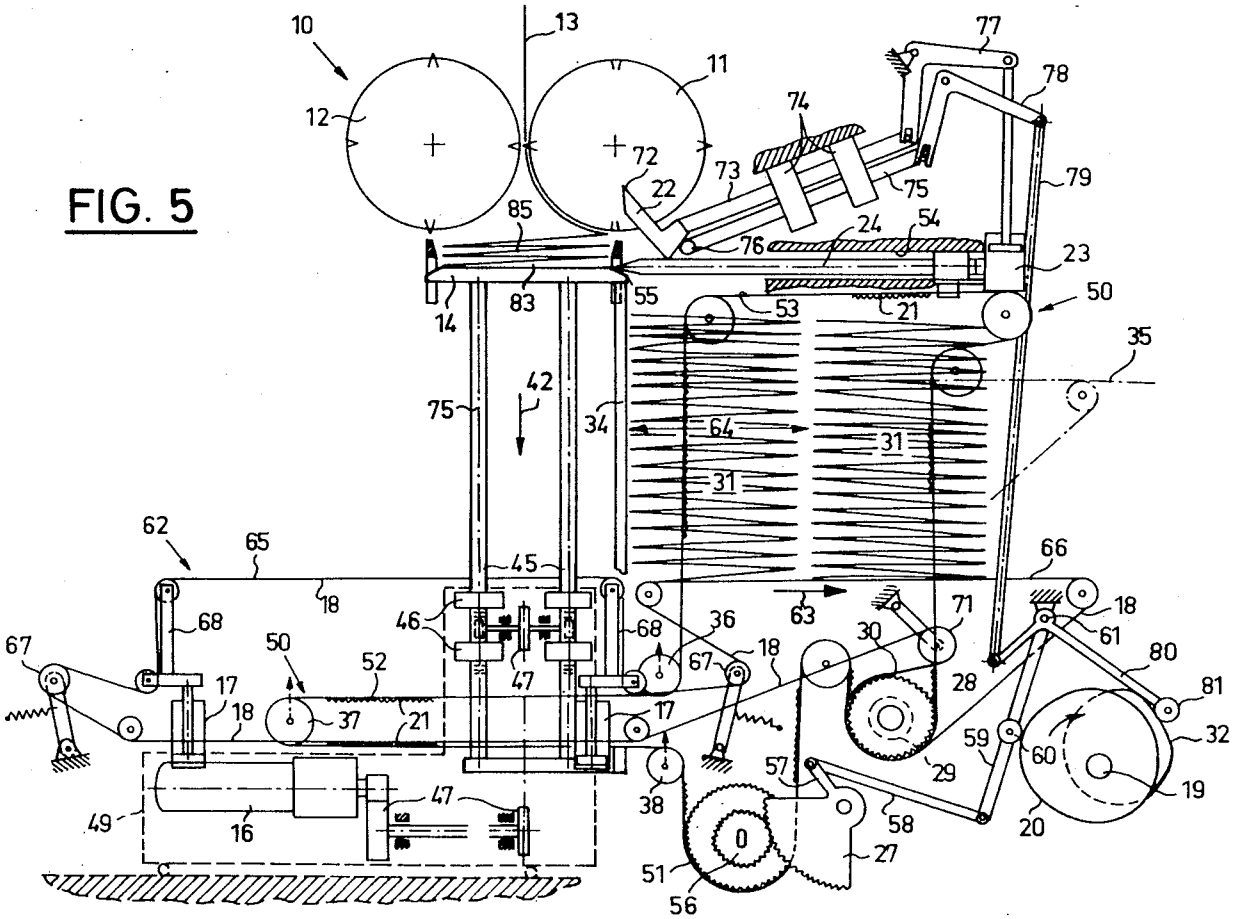

FIG. 5 shows that under the action of the further rotating cam 20 via the connecting mechanism, the segment 27 is now pivoted to the other side, so that the driving gear 51 moves the toothed belt 21 of displacement means 50 in such a way that the separating means 24 and stacking table 14 are moved horizontally to the right in a synchronous manner and in the same direction, so that the stacking means 24 passes out of the stacking zone 41 and stacking table 14 is introduced into the latter. Stacking table 14 and separating means 24 follow one another without a gap moving together with toothed belt 21, and in fact overlap to a certain extent, in that the tips 55 of the separating means are positioned on a lateral bevel of the stacking table. This reciprocal position had been assumed in FIG. 4 and is maintained during the transfer to the right (as in FIG. 5). The partial stack 85 formed on separating means 24 is moved by the right-hand side guide member 44 onto stacking table 14, which now again assumes its function of a lowerable stack support. Corresponding to the accumulation of the stack, stacking table 14 is lowered in stacking direction 42 by motor 16 (FIG. 1).

FIG. 5 also shows that simultaneously with the movement of toothed belt 21, the entrainer gear 28 is rotated which, by means of the freewheel means 29, entrained in said direction the driving gear 30 for belt conveyor 18 and consequently also moved conveyor belt 18 by amount 64 and namely to the right in the vicinity of belt sections 65, 66, which are at the same level here, i.e. below the separating means 24 and between gears 21. The stack is supported by support strips 34 whilst passing over the gap between the two belt sections 65, 66. Thus, there is an intermittent removal of the stack 31 formed on belt section 66, from where it can be conveyed on or taken off.

Belt conveyor 18 can also be replaced by some other removal means, e.g. a means operating with sliders or gripping fingers moving the stacks on a table or roller tracks. Although the raising of the belt section part 65 is advantageous and after the subsequent lowering of this section an adequate free space is formed over the stack to permit the removal thereof below the separating means, it would also be possible through corresponding further lowering of the stacking table to permit transfer with a constant belt section height.

The indirect driving of belt conveyor 18 via the toothed belt by means of a freewheel means ensures a reliable synchronization of the movements of toothed belt 21 and belt conveyor 18. However, the belt conveyor could also have a direct drive derived from the synchronous shaft 19. The latter is so connected to the drive of folding rollers 11, 12 that it performs a rotation for a certain minimum number of layers 40, e.g. 100 or 200 sheets. If stacks with a larger or smaller number of layers dividable by this minimum number were required, then the synchronous shaft 19 would be disengaged for a few rotations. During this time the stack is formed (in the position between FIG. 5 and the following FIG. 1 in the cycle). However, it is also possible by coupling in at a different point to obtain a different number of layers which are not dividable by said minimum number or to allow layer counting to take place by other means instead of the folder. Motor 16 and pneumatic cylinders 17, 23 are controlled by a control mechanism in the described sequence and said mechanism can e.g. also be operated by means of cams or disc cams on synchronous shaft 29. The speed of motor 16 must be regulatable in accordance with the stack growth speed.

Figure 6:
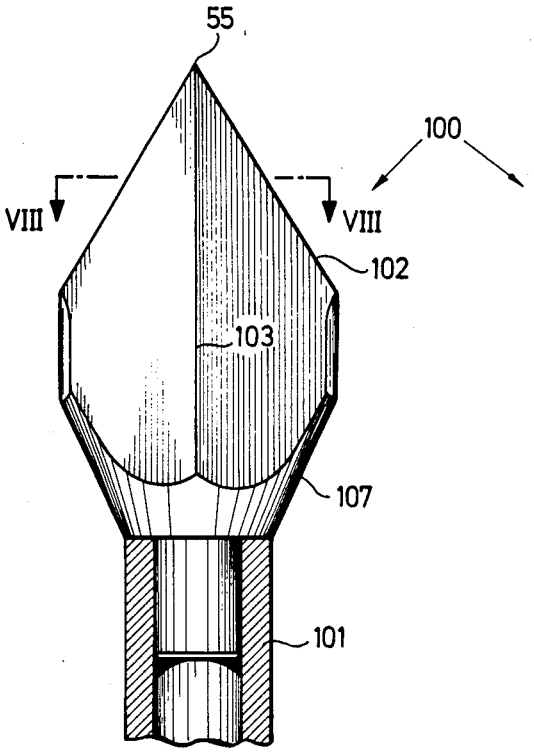
FIG. 6 shows a plan view of a separating head.
Figure 7:
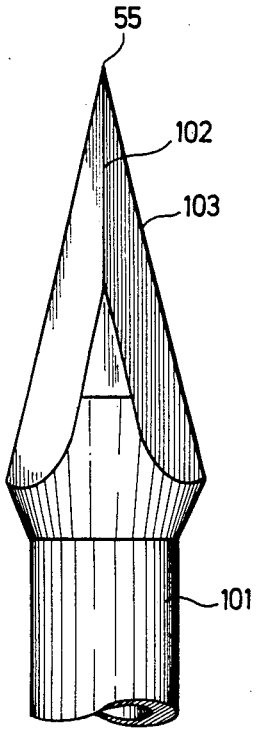
FIG. 7 shows a side view of a separating head.
Figure 8:
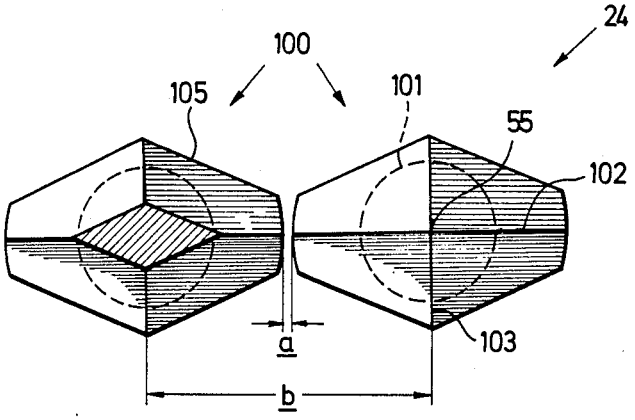
FIG. 8 shows a front view of two separating heads.

The separating head 100 shown in FIGS. 6 to 8 forms the front end of each rod 101 of separating means 24. Rods 101 are horizontal and parallel to one another in the insertion direction of separating means 24. Separating head 100 has the shape of a spear tip with a rhombic cross-section, whose edges 102, 103 come together in the front tip 55. The separating head is wider and thicker than the associated bar 101, so that between in each case two separating heads 100 a very small spacing a is formed in the horizontal direction and only represents a fraction of the total width of the head or the spacing t between the bars (preferably 5 to 10%). Separating head 100 has the larger width of its rhombic cross-section in the horizontal direction and the edges 102 pointing in this direction form an angle between 45° and 90°, preferably approximately 60°. The angle formed by the upwardly and downwardly pointing edges 103 is approximately only half as large and is between 25° and 40°, preferably just 30°. The rhombic tip passes in the vicinity of edges 102 into a cylindrical cross-section and then into a conical cross-section 107, which reduces the total width of the separating head to the dimensions of rod 101. Edges 102, 103 are not ground sharp and are instead deburred.

This leads to a flat, wedge-like blade, which only breaks open and does not cut the web at the perforated folding edges. The web is curved along the fold in a wavy up and down manner and the parts holding together the web parts are broken open in planned form. What is important is the force components produced by the separating head in the horizontal and vertical directions and not the cutting capacity of the edges. Thus, they need not be as marked as in the represented example. In particular there is no need for edge 103, so that the tip could have a lenticular cross-section. Thus, the described separating head tears the perforating parts in a successive manner without tearing the web and namely without exerting great transverse forces on the stack. The juxtaposed separating heads 100 engage in the recesses of a strip 44 at the end of their travel. The wavy surfaces on the top and bottom of the separating means 24 formed by the linked separating faces 105 (FIG. 8) are so far apart in the end position of the separating stroke that with the limited spacing a a portion located in the gap would be reliably torn.

What is claimed is:

1. An apparatus for forming folded stacks from a web, comprising:

folding means for bending the webs at folding edges into multiple layers forming the stack, a stacking zone being defined adjacent to the folding means, in which stacking zone the stack is accumulated and is carried by stacking table means, separating means movable by separating drive means along a plane substantially parallel to the layers of the stack, thereby performing an inserting movement of the separating means into the stack and a retracting movement from the stack in said plane, the separating means being provided with frontal severing means for separating from each other during said inserting movement two adjacent layers of the stack at adjacent folding edges, and thereby separating the stack into an upper stack part and a lower stack part, the separating means being adapted to at least temporarily carry the upper stack part, stack removal means provided at a lower end of the stacking zone for removing the lower stack part from the stacking zone and from the stacking table means, the stacking table means being movable in a substantially vertical direction from an upper level adjacent to the separating means to a lower level adjacent to the stack removal means by vertical movement means, and said stacking table means being movable substantially horizontally by horizontal displacement means between a position beside and outside the stacking zone and a position inside the stacking zone, the stacking table means being sequentially movable by said vertical movement means and said horizontal displacement means from the lower level to the upper level while the stacking table means is in the position beside and outside the stacking zone, from the outside position to the inside position while the stacking table means is on the upper level, the stacking table means closely following the separation means during the retracting movement and thereby resuming support of the upper stack part upon retraction of the separation means, from the upper level to the lower level in the inside position, during which movement the stack is accumulated on the stacking table, and, from the inside position to the outside position on the lower level after the stack is transferred from the stacking table means to the removal means.

2. An apparatus according to claim 1, wherein the separating means comprises a plurality of movable, rake-like separating bars provided with the frontal severing means arranged in a separating plane and which cooperate with a guide member having recesses along the stacking edge, the separating means engaging in the recesses of the guide member.

3. An apparatus according to claim 2, wherein the severing means comprise severing edges, the edges being defined on a plurality of separating rods having separating heads with a spear tip configuration.

4. An apparatus according to claim 3, wherein the separating head tapering to a tip at the front has a rhombic cross-section with four separating edges.

5. An apparatus according to claim 4, wherein the separating head is roughly twice as thick as wide and its longer diagonal is located in the separating plane.

6. An apparatus according to claim 3, wherein the angle formed between the severing edges in the separating plane is between 45° and 90°.

7. An apparatus according to claim 3, wherein the angle formed between the severing edges pointing at right angles to the separating plane is between 25° and 40°.

8. An apparatus according to claim 3, wherein the separating heads project over the circumference of the separating rods and leave spacings between them which are smaller than the thickness of the heads.

9. An apparatus according to claim 8, wherein the spacings are approximately 5 to 10% of the spacing between the separating rods.

10. An apparatus according to claim 1, wherein the stack removal means is formed by a belt conveyor and wherein a partial belt section of the belt conveyor can be raised over the plane of the stacking tables to thereby engage and carry the lower stack part.

11. An apparatus according to claim 10, wherein a driving gear of the belt conveyor is coupled by means of a free wheel means acting only in one drive direction to the displacement means and is driven intermittently by the displacement means.

12. An apparatus according to claim 11, wherein the displacement means for the stacking table contains a slide on which is also arranged the raising and lowering means.

13. An apparatus according to claim 12, wherein the displacement means contains at least one toothed belt driveable in an oscillating manner.

14. An apparatus according to claim 1, wherein linked with the stacking table means are supports extending downwards therefrom for defining a stacking edge.

15. An apparatus according to claim 1, wherein there is a dividing member constructed for engaging the stack at an edge thereof, from which edge the separating means commence the inserting movement, the dividing member briefly forming a gap in the stack, into which the separating means is introduced, the remaining stack being divided by the separating means.

16. An apparatus according to claim 15, wherein the dividing member is downwardly movable with the stack.

17. An apparatus according to claim 15, wherein the dividing member can be introduced into the stack from the top thereof.

18. An apparatus according to claim 15, wherein the dividing member is pivotable and displaceable.

19. An apparatus according to claim 18, wherein the dividing member is articulated on two parallel-guided, independently longitudinally displaceable drive rods.

20. An apparatus according to claim 1, wherein there is a presettable height adjustment means for the removal means.

21. An apparatus according to claim 1, wherein the drive of the separating means and the removal means is operable by means of an adjustable gear driven synchronously with the folding means.

* * * * *